US012227946B2

(12) United States Patent
Robles

(10) Patent No.: US 12,227,946 B2
(45) Date of Patent: Feb. 18, 2025

(54) WALL ROOF TRUSS BUILDING SYSTEM

(71) Applicant: Mary Lou Robles, Boulder, CO (US)

(72) Inventor: Mary Lou Robles, Boulder, CO (US)

( * ) Notice: Subject to any disclaimer, the term of this patent is extended or adjusted under 35 U.S.C. 154(b) by 256 days.

(21) Appl. No.: 17/580,834

(22) Filed: Jan. 21, 2022

(65) Prior Publication Data

US 2022/0235549 A1 Jul. 28, 2022

Related U.S. Application Data

(60) Provisional application No. 63/140,345, filed on Jan. 22, 2021.

(51) Int. Cl.

| | |
|---|---|
| ***E04C 3/38*** | (2006.01) |
| ***E04B 1/34*** | (2006.01) |
| ***E04B 1/344*** | (2006.01) |
| ***E04B 7/02*** | (2006.01) |
| *E04C 3/02* | (2006.01) |

(52) U.S. Cl.

CPC ..... *E04C 3/38* (2013.01); *E04B 1/3408* (2013.01); *E04B 1/344* (2013.01); *E04B 7/022* (2013.01); *E04C 3/02* (2013.01)

(58) Field of Classification Search

CPC ..... E04B 1/3408; E04B 1/344; E04B 1/3441; E04B 7/022; E04B 7/024; E04C 3/02; E04C 2003/026; E04C 3/38; E04C 3/40; E04C 3/42; E04C 3/44; E04C 3/46

USPC ..... 52/641, 645, 646, 648.1, 649.5

See application file for complete search history.

(56) References Cited

U.S. PATENT DOCUMENTS

| | | | | |
|---|---|---|---|---|
| 1,994 A * | 2/1841 | Price et al. | E04C 13/02 | 52/695 |
| 915,378 A * | 6/1909 | Phautz et al. | B61B 13/04 | 104/94 |
| 2,390,180 A | 12/1945 | Sahlberg | | |
| 3,156,018 A * | 11/1964 | Slayter | E04B 1/348 | 52/79.9 |
| 3,214,872 A * | 11/1965 | Vogelgesang | E04B 1/3408 | 52/643 |
| 3,263,381 A | 8/1966 | Dickinson | | |
| 4,156,433 A * | 5/1979 | Beaulieu | E04B 1/3441 | 52/109 |
| 4,201,021 A | 5/1980 | Aldag | | |

(Continued)

OTHER PUBLICATIONS

Hive House by Studio 512, web page https://www.architecturalrecord.com/articles/13200-hive-house-by-studio-512, Jan. 17, 2018.

(Continued)

*Primary Examiner* — Brent W Herring

(74) *Attorney, Agent, or Firm* — University of Colorado Entreprenurial Law Clinic

(57) ABSTRACT

A frame truss made of two walls and a roof structure. Each of the two walls have an outer and inner chord. The outer and inner chords of each respective wall are not parallel, but the inner chords of the two walls are parallel to each other. The arrangement of the inner and outer chords of each wall creates an exterior overhang with respect to the ground. Each of the walls converge at their bases and are attached at their bases to a plate. The roof structure attaches to the top of each of the walls and spans between them creating a frame that can be assembled in conjunction with similar frames to construct a building system.

19 Claims, 11 Drawing Sheets

(56) References Cited

U.S. PATENT DOCUMENTS

| | | | | |
|---|---|---|---|---|
| 4,373,305 | A * | 2/1983 | Russell | E04B 1/32 52/645 |
| 4,656,792 | A | 4/1987 | Clark | |
| 5,606,837 | A * | 3/1997 | Holizlander | E04G 21/1891 52/696 |
| 7,200,972 | B1 * | 4/2007 | Freeman | F16B 15/0046 52/712 |
| 2008/0092481 | A1 * | 4/2008 | Ellen | E04B 1/28 52/741.11 |
| 2010/0251660 | A1 * | 10/2010 | McCann | E04C 3/17 52/677 |
| 2022/0145632 | A1 * | 5/2022 | Aitken | E04C 3/42 |

OTHER PUBLICATIONS

House in Shinyoshida, web page https://web.archive.org/web/20171211203947/http://fujiia.c.ooco.jp/shinyo_e_html, archived as of Dec. 11, 2017.

An Origami-Like CLT Roof Crowns This Office in Japan, web page https://inhabitat.com/an-origami-like-clt-roof-crowns-this-office-in-japan/synegic-office-uenoa-7/, Apr. 7, 2020.

* cited by examiner

WALL ROOF TRUSS BUILDING SYSTEM

This application claims the benefit of U.S. Provisional Patent Application No. 63/140,345, filed on Jan. 22, 2021, the contents of which are herein incorporated by reference in their entirety.

TECHNICAL FIELD

Embodiments related to the present disclosure are related to general building construction. More specifically, the present disclosure relates to structural elements and building components.

BACKGROUND

Residential buildings are typically built by hand-framing lumber to make vertical exterior walls. After construction of the vertical exterior walls, roof trusses are set to bear on top to the exterior walls. The lumber chosen for this typical building method also determines the thickness of the walls. Normally, the lumber chosen for the exterior walls is 2×6 nominal inches, resulting in an exterior wall thickness of anywhere between, 8 and 12 nominal inches depending on exterior siding. Residential insulation materials are often engineered to account for this; because heat transfer is inversely related to the thickness of the wall, materials with lower thermal conductivity is often used to control for large temperature gradients between the exterior and interior of the residential unit. Lower thermal conductivity materials light enough for construction are often expensive and come from non-renewable sources. The vertical nature of the walls also often calls for the use of gutters; without gutters, in some instances water from rain or melting snow adheres to the vertical walls due to surface tension, and water travels down the walls concentrating at, and damaging, the foundation and/or cellar.

Hand-framing the vertical exterior walls often involves skilled on-site construction teams. Typically, the nominal lumber is transported to the site, cut to specification, connected together by use of a pneumatic nail gun, and erected. Because materials are relatively inexpensive, speed becomes a primary objective on the job site, thus creating waste at the jobsite in some cases.

Alternative methods of residential construction have been implemented, such as metal and concrete. Metal, and metal-concrete construction techniques are typically used in commercial or apartment buildings, but they remain cost inhibitive for most single-family dwellings due to materials and highly skilled labor requirements; these methods can also significantly add to carbon dioxide emissions. Environmentally friendlier options such as poured-earth, geodesic domes, log cabins, or cobb homes are often not scalable in construction and can limit architectural freedom in some cases.

BRIEF SUMMARY

Some embodiments of the present disclosure are related to a wooden frame truss that can be used in a modular fashion to quickly, and easily assemble a residential dwelling unit. Specifically, some embodiments relate to a four-sided frame truss wherein each wall and the roof is a truss, the trusses each having non-parallel chords, where in the outer chords of the wall trusses are arranged to create an overhang. As used herein the term chords is meant to encompass beams or other building elements that are used to construct a wall truss, truss, or other housing structure. In some cases, chords can include dimensional lumber, other wood beams such as I-beams, logs, or joists. Chords can also include beams or other building components made from other materials such as aluminum, steel or other suitable metal, plastic, composites, or other suitable material such as concrete, or combinations thereof. These embodiments solve the issue of water adhesion and allow the use of renewable, higher-thermal conductivity insulation materials. One embodiment of the wall roof truss building system described herein has walls arrange to create a roof pitch capable projecting water far from the structure. In some embodiments, the thickness of the wall allows for more insulate material, giving the possibility that the wall truss can be insulated with high thermal conductivity material and retain a substantially similar heat transfer coefficient to that of a traditionally built structure with low-thermal conductivity insulation material. Additionally, these embodiments sequester carbon due to their wood construction, and maintain a reduced cost.

Some embodiments of the present disclosure relate to a symmetrical residential dwelling unit, where each of the walls is substantially the same size, and connects to a roof element in a substantially similar fashion. Some embodiments of the present disclosure are related to a frame truss that is not symmetrical with respect to a vertical axis, where each of the two walls are different sizes and can attach to a roof element at different angles. Some embodiments of the present disclosure have a roof element that is made of a single beam; other embodiments include a roof element that is a truss. Some embodiments also include a hinge, or plurality of hinges, to allow the frame truss to be folded and transported to the build site.

Another embodiment of the current disclosure is a system of building a structure using frame trusses fabricated off-site. The frame trusses can be shipped to the jobsite, erected, and connected using pre-made connector-pieces with friction fittings. In some embodiments the connector pieces can be used to connect multiple frame trusses together using only friction. The connector piece can be a sheet good, girt, purlin, or beam. In some embodiments the connector-piece is a box, allowing a window or doorway to be framed in between the frame trusses. The building method may include different sized frame trusses for various wings of the residential structure, and can be constructed simply using the connector pieces. The off-site fabrication and ease of assembly reduce build time and costs, according to some embodiments.

Figure 1:
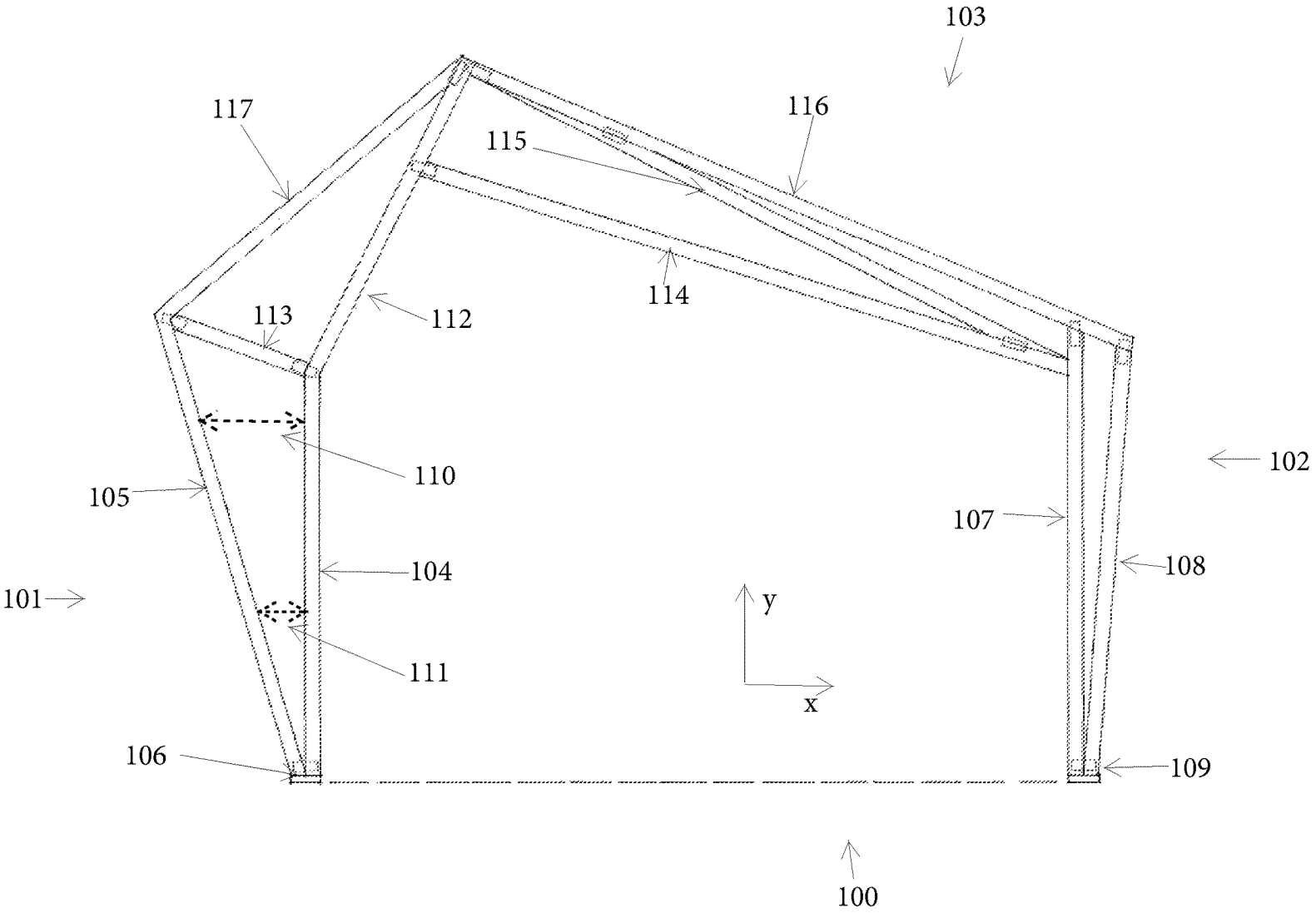
FIG. 1 illustrates a front elevation view of a wall roof truss building system, according to embodiments of the present disclosure.

Corresponding reference characters indicate corresponding parts throughout the several views. While the disclosure is amenable to various modifications and alternative forms, specific embodiments have been shown by way of example in the drawings and are described in detail below. The intention, however, is not to limit the disclosure to the particular embodiments described. On the contrary, the disclosure is intended to cover all modifications, equivalents, and alternatives falling within the scope of the disclosure as defined by the appended claims.

DETAILED DESCRIPTION

Embodiments of the present disclosure include wall roof frame trusses where the walls of the frame are trusses, such that the exterior or outer part of the wall creates an overhang.

As shown in FIG. 1, in one embodiment, a wall roof truss building system ("WRTBS") 100 includes a first wall 101, and a second wall 102, and a roof element 103. The roof element 103 includes several roof chords 112, 113, 114, 115, 116, and 117. The first wall 101 includes an inner chord 104, an outer chord 105, and a template plate 106. The inner chord 104 and outer chord 105 are configured to attach to the template plate 106. The inner chord 104 and outer chord 105 of the first wall 101 are also configured to attach to the roof element 103. The inner chord 104 and the outer chord 105 of the first wall 101 are non-parallel. The angle of the outer chord 105 creates an overhang at the intersection between the outer chord 105 and the roof chord 117. The second wall 102 includes an inner chord 107, and outer chord 108, and a template plate 109. The inner chord 107 and outer chord 108 are configured to attach to the template plate 109. The inner chord 107 and outer chord 108 of the second wall 102 are also configured to attach to the roof element 103. The inner chord 107 and the outer chord 108 of the second wall 102 are non-parallel. The angle of the outer chord 108 creates an overhang at the intersection between the outer chord 108 and the roof chord 116. The inner chord 104 of the first wall 101, and the inner chord 107 of the second wall 102 can be substantially parallel. The distance 110 between the upper portions of the inner 104 and outer chord 105 of the first wall is greater than the distance 111 between the lower portions of the inner 104 and outer chord 105.

According to some embodiments, the elements 101-117 of the WRTBS 100 can be made of wood, metal, composite, polymers, or any combination thereof. The WRTBS elements 101-117 can be connected using plates made of metal, composite wraps, composite fittings, glue, or adhesive, or other connection mechanisms.

Figure 2:
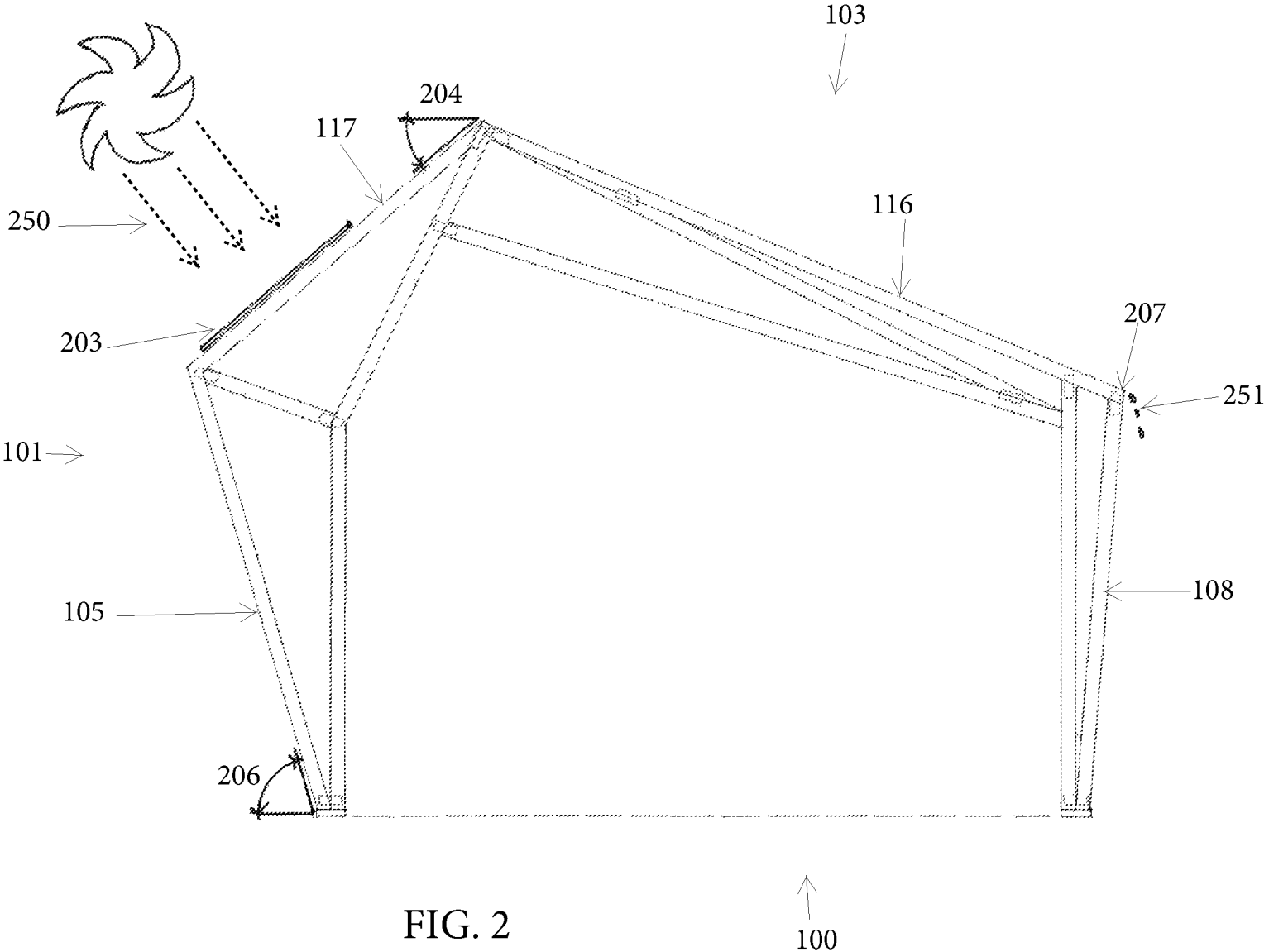
FIG. 2 illustrates a front elevation view of a wall roof truss building system, according to embodiments of the present disclosure.

In some embodiments, as illustrated in FIG. 2, the WRTBS 100 includes a photovoltaic panel 203 lying flat on the roof chord 117 of the roof element 103, where angle 204 of the roof chord 117 allows for an efficient incident angle with respect to sunlight exposure 250. According to some embodiments, the outer chord 105 is arranged at an angle 206 optimized to reduce solar radiative heat transfer. Specifically, the outer chord 105 forms an acute angle 206 with respect to a ground surface outside of the dwelling, which can reduce direct sunlight exposure to first wall 101. Angle 206 is formed between a horizontal surface (e.g., such as a flat underlying surface, or a ground surface) and outer chord 105. According to some embodiments, the connection 207 between the roof chord 116 and the outer chord 108 facilitates flow of precipitation 251 off the roof element 103 at a trajectory that protects the siding and foundation of the WRTBS 100.

Figure 3:
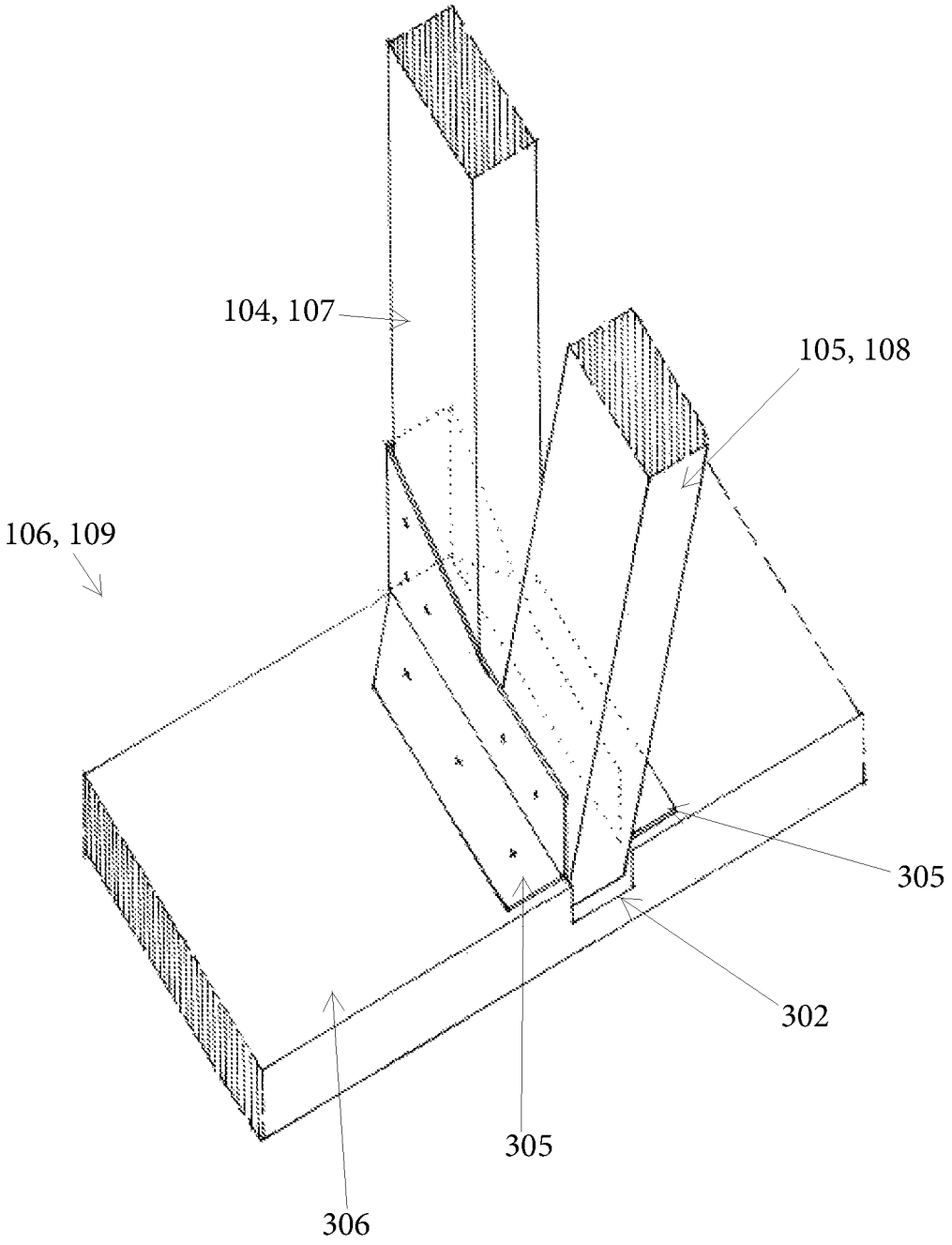
FIG. 3 illustrates a side perspective view of a template plate groove, according to embodiments of the present disclosure

In some embodiments, as illustrated in FIG. 3, the first and/or second template plate 106, 109 includes a base element 306, and a groove 302 which may be formed in the base element 306, to accommodate the inner chord 104, 107 and the outer chord 105, 108. In some embodiments the inner chord 104, 107 and the outer chord 105, 108 are attached to the template plate 106,109 via a metal plate or bracket 305. Groove 302 may be formed (e.g. by milling, carving, sawing, chiseling, or the like) directly into the base element 306. Alternatively, groove 302 may be formed by or part of the bracket 305, or formed by a combination of bracket 305 and base element 306. Some embodiments include two brackets 305 on opposing sides of the chords 104, 107 and 105, 108. Base element 306 in some embodiments is a footer, or an anchor, or otherwise coupled to or embedded within the ground, a foundation, or some other foundational or base element to which the WRTBS 100 is attached and/or stabilized. According to some embodiments, the chords 104 and 05 are rigidly or fixedly coupled to the base element 306, for example via brackets 305.

Figure 4B:
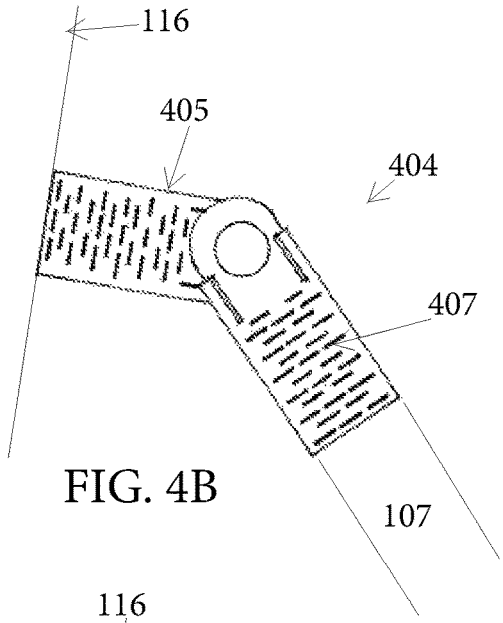
FIG. 4B illustrates a side perspective of the hinge of FIG. 4A, according to embodiments of the present disclosure.
Figure 4A:
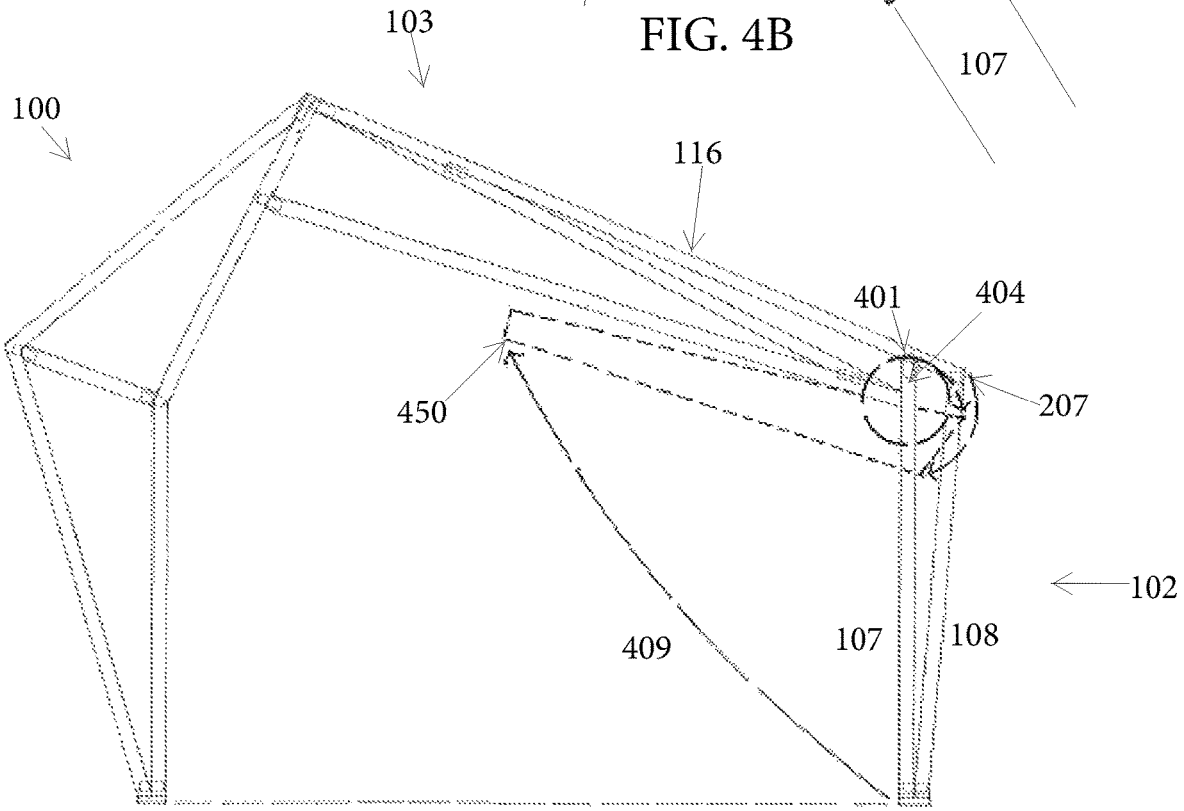
FIG. 4A illustrates a front elevation view of a wall roof truss building system incorporating a hinge, according to embodiments of the present disclosure.

In some embodiments, as illustrated in the FIG. 4A and FIG. 4B, the connection 401 between an inner chord 107 and the roof chord 116 includes a hinge 404. The hinge includes a first hinge part 405 attached to the roof chord 116 and a second hinge part 407 attached to the inner chord 107. The first hinge part 405 is rotatable with respect to the second hinge part 407. This allows the second wall 102 to fold inward along 409 with respect to the roof element 103 when the outer chord 108 is disconnected from the roof chord 116 at connection point 207. The dotted line in FIG. 4A shows a folded position 450 of the outer wall 102, which facilitates ease of transportation of the WRTBS 100. The hinge 404 may be made of metal or a composite.

Figure 5:
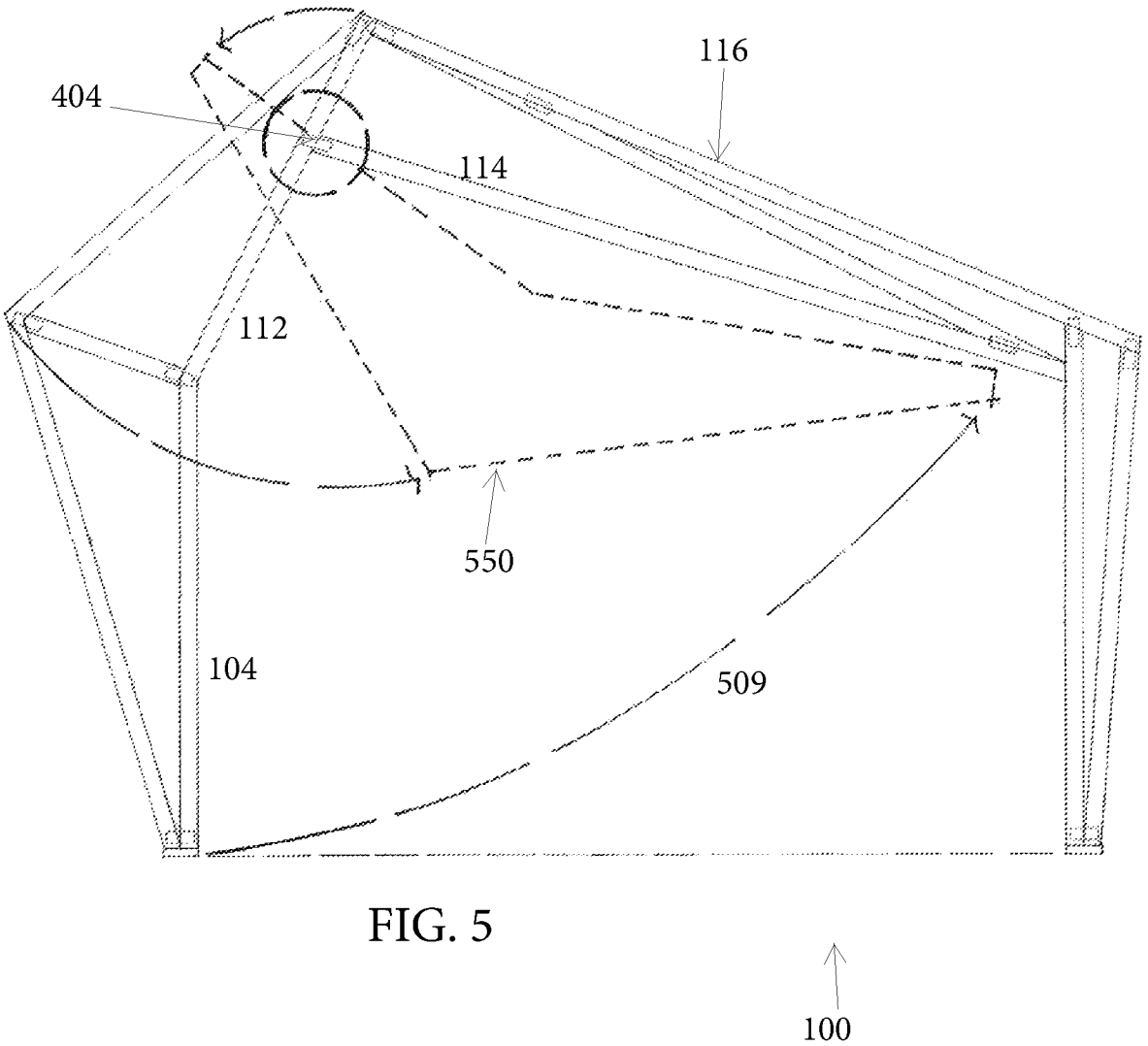
FIG. 5 illustrates a front elevation view of a wall roof truss building system incorporating a hinge, according to embodiments of the present disclosure.

FIG. 5 illustrates one embodiment in which a hinge 404 connects roof chord 112 to roof chord 114, enabling the WRTBS 100 to be folded along direction 509. The dotted line in FIG. 5 shows a folded position of the left side of the WRTBS 100. For example, the hinge 404 can be positioned at a mid-portion of the roof chord 112, and an end portion of the roof chord 112 can detachably couple to the roof chord 116. Accordingly, when the end portion of the roof chord 112 is detached from the roof chord 116, the left portion of the WRTBS 100 can rotate inwards, facilitating ease of transportation. In some embodiments, the WRTBS 100 includes two hinges 404; one at the location shown in FIG. 5, and one at the location shown in FIGS. 4A, 4B. In some embodiments, the WRTBS 100 includes additional hinges at other connection points to allow for additional folding.

Figure 6:
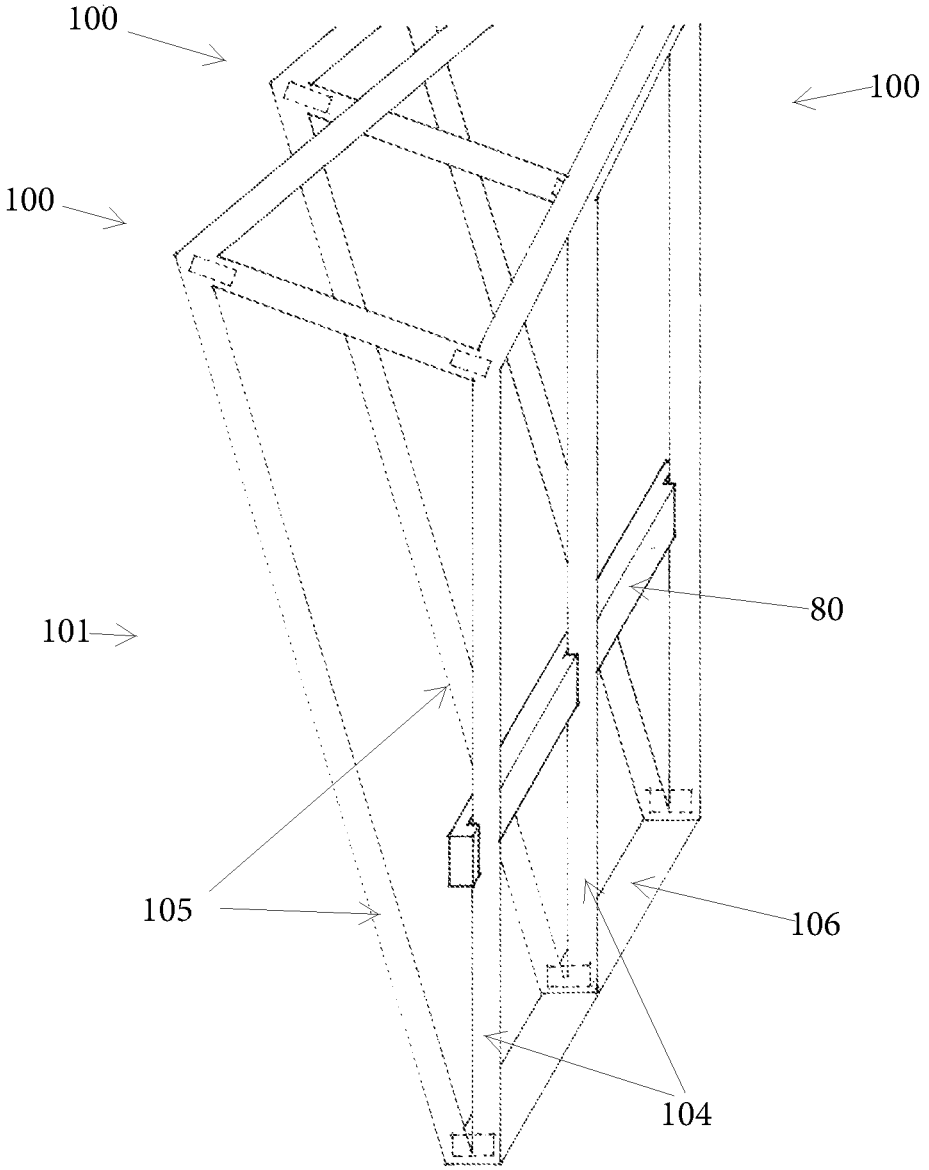
FIG. 6 illustrates a perspective view of a wall roof truss building system with a perpendicular blocking element, according to embodiments of the present disclosure.

FIG. 6 illustrates a partial view of a series of WRTBS 100 arranged in parallel to form the frame of a dwelling unit. FIG. 6 shows three WRTBS 100 by way of illustration, however, some embodiments include additional WRTBS 100. Each WRTBS 100 is attached to the first template plate 106, as illustrated in detail FIG. 3. A perpendicular blocking element 80 is coupled to the inner chord 104 of multiple WRTBS 100 to provide structural support. In some embodiments, the perpendicular blocking element 80 is coupled to each inner chord 104 via a friction fitting, without the use of nails, brackets or other hardware. This allows the perpendicular blocking element 80 to be coupled to the WRTBS 100 using a mallet, for example, facilitating ease of construction. It is noted that, while FIG. 6 illustrates the first wall 101, the second wall 102 may have a similar arrangement as shown in FIG. 6.

Figure 8:
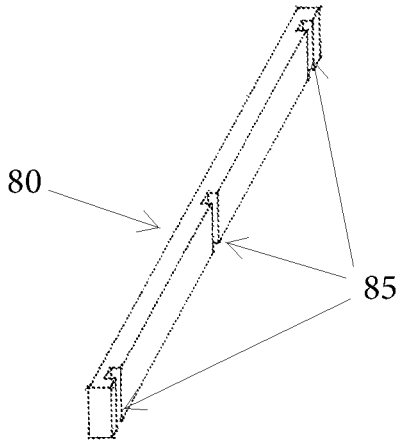
FIG. 8 illustrates a perspective view of the perpendicular blocking element, according to embodiments of the present disclosure.
Figure 12:
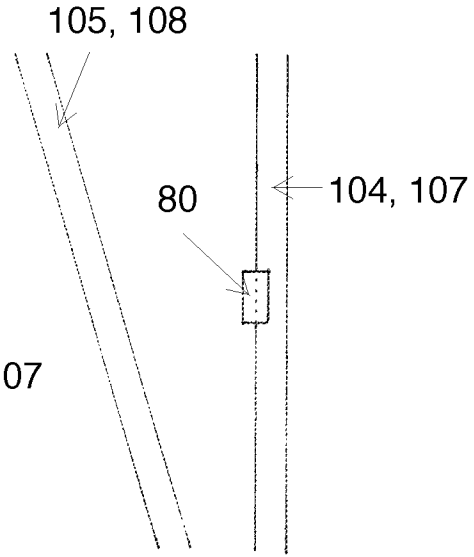
FIG. 12 illustrates a side view of a wall roof truss building system incorporating a perpendicular blocking element, according to embodiments of the present disclosure.

FIG. 8 shows an isolated view of the perpendicular blocking element 80. The perpendicular blocking element 80 includes notches 85, each of which engages with an inner chord 104, 107, of a respective WRTBS 100 via a friction fitting. In some embodiments, the perpendicular blocking element 80 is made of a composite material. In other embodiments the perpendicular blocking element 80 is made from other materials such as wood, aluminum, steel or other suitable metal, plastic, concrete, or combinations thereof. FIG. 12 shows a side view of the perpendicular blocking element 80 engaging with inner chords 104, 107.

Figure 7:
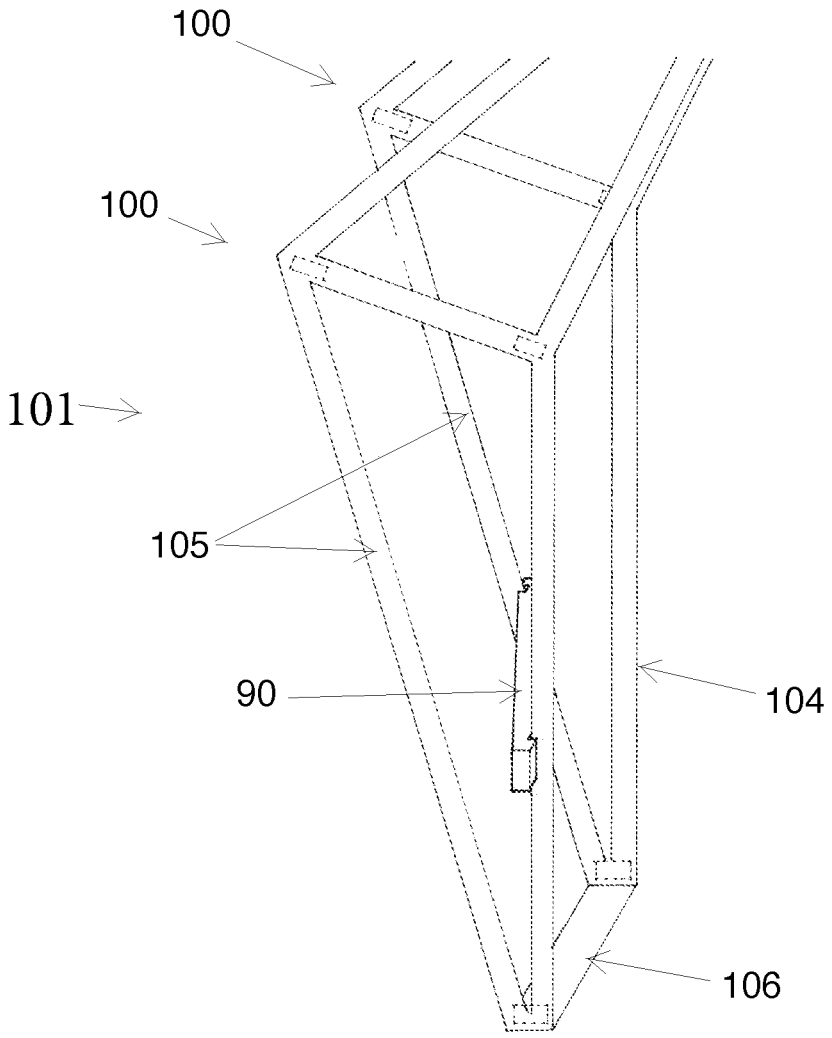
FIG. 7 illustrates a perspective view of a wall roof truss building system with a diagonal blocking element, according to embodiments of the present disclosure.

FIG. 7 illustrates another partial view of a series of WRTBS 100 arranged in parallel to form the frame of a house. A diagonal blocking element 90 is coupled to the inner chord 104 of one WRTBS 100 and the outer chord 105 of an adjacent WRTBS 100 to provide structural support. In some embodiments, the diagonal blocking element 90 is coupled to the inner chord 104 and outer chord 105 via a friction fitting, without the use of nails, brackets or other hardware. This allows the diagonal blocking element 90 to be coupled to the WRTBS 100 using a mallet, for example, facilitating ease of construction. It is noted that, while FIG. 7 illustrates the first wall 101, the second wall 102 may have a similar arrangement as shown in FIG. 7.

Figure 9:
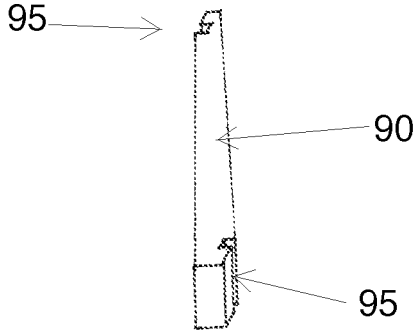
FIG. 9 illustrates a perspective view of the diagonal blocking element, according to embodiments of the present disclosure.
Figure 10:
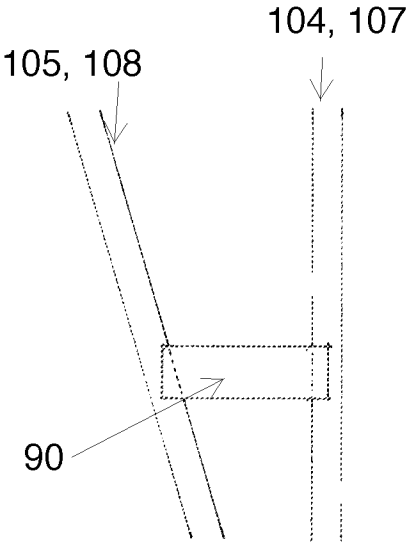
FIG. 10 illustrates a side view of a wall roof truss building system incorporating a diagonal blocking element, according to embodiments of the present disclosure.

FIG. 9 shows an isolated view of the diagonal blocking element 90. The diagonal blocking element 90 includes two notches 95. One notch 95 engages with an inner chord 104, 107, of a WRTBS 100, and the other notch 95 engages with an outer chord 105, 108 of an adjacent WRTBS 100. In some embodiments, the diagonal blocking element 90 is made of a composite material. In other embodiments the diagonal blocking element 90 is made from other materials such as wood, aluminum, steel or other suitable metal, plastic, concrete, or combinations thereof. FIG. 10 shows a side view of the diagonal blocking element 90 engaging with an inner chord 104, 107 and an outer chord 105, 108.

Figure 11:
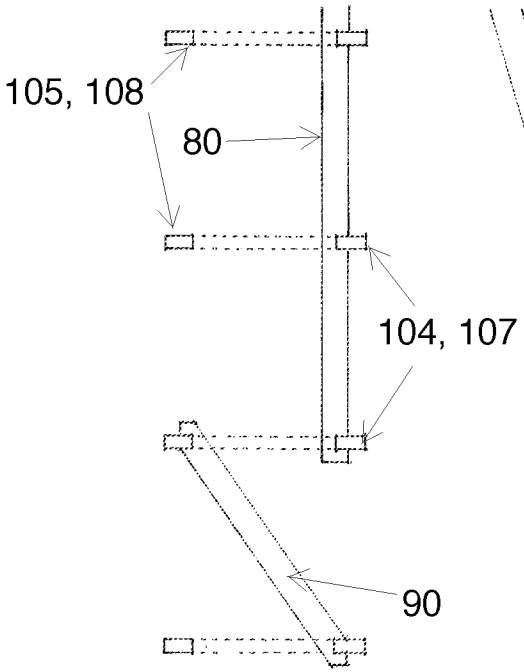
FIG. 11 illustrates a top view of a wall roof truss building system incorporating a diagonal blocking element and a perpendicular blocking element, according to embodiments of the present disclosure.

FIG. 11 shows a top down view of a perpendicular blocking element 80, a diagonal blocking element 90, inner chords 104, 107, and outer chords 105, 108.

Figure 13:
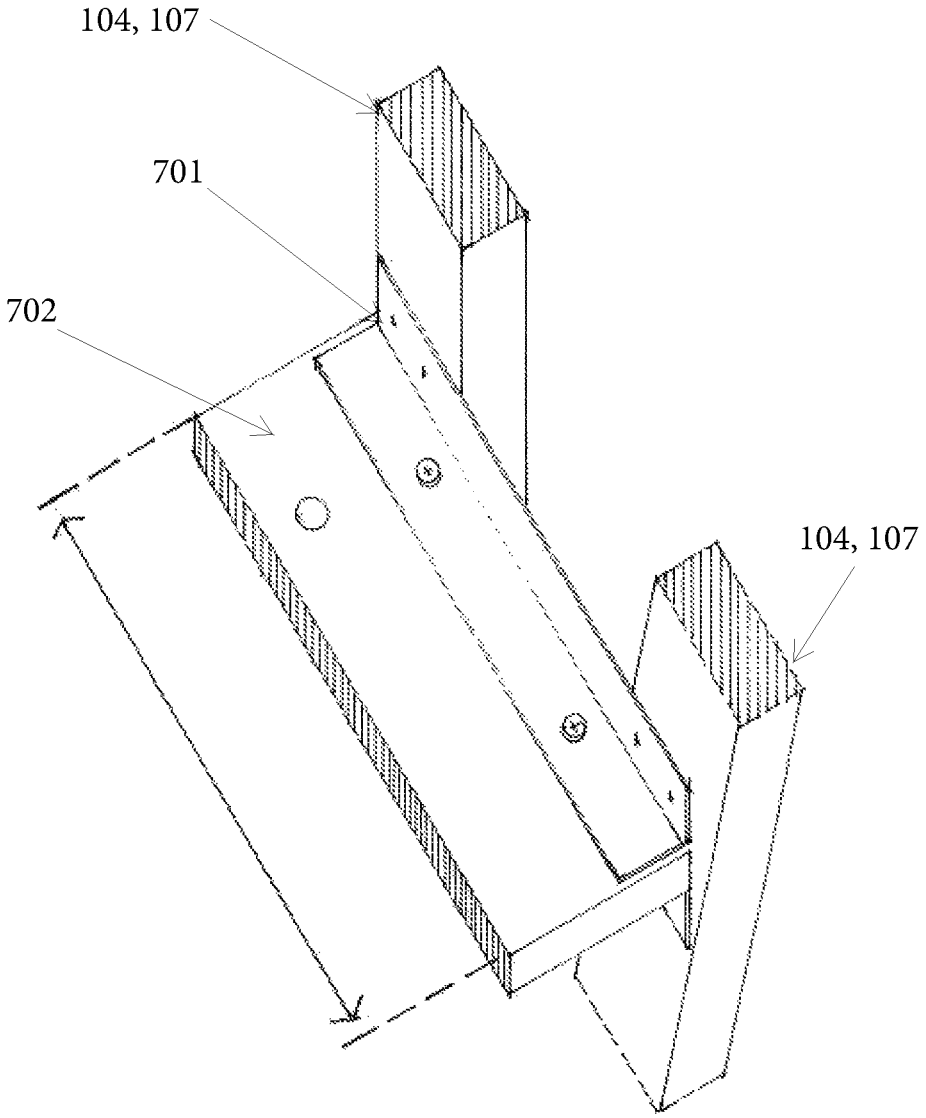
FIG. 13 illustrates a perspective view of a connector piece, according to embodiments of the present disclosure.

FIG. 13 illustrates a connector piece 702 which can be used in addition to or in lieu of the blocking elements 80, 90. The connector piece 702 may connect the inner chords 104, 107 of multiple WRTBS 100. Although the connector piece 702 is shown connecting inner chords 104, 107, it may also be used to connect outer chords 105, 108. In one embodiment, the connector piece 702 is attached to the chords 104, 107 via a plate 701. In other embodiments, the connector piece 702 may be attached to the chords 104, 107 using a tie, a strap, or any other suitable attachment mechanism.

Figure 14:
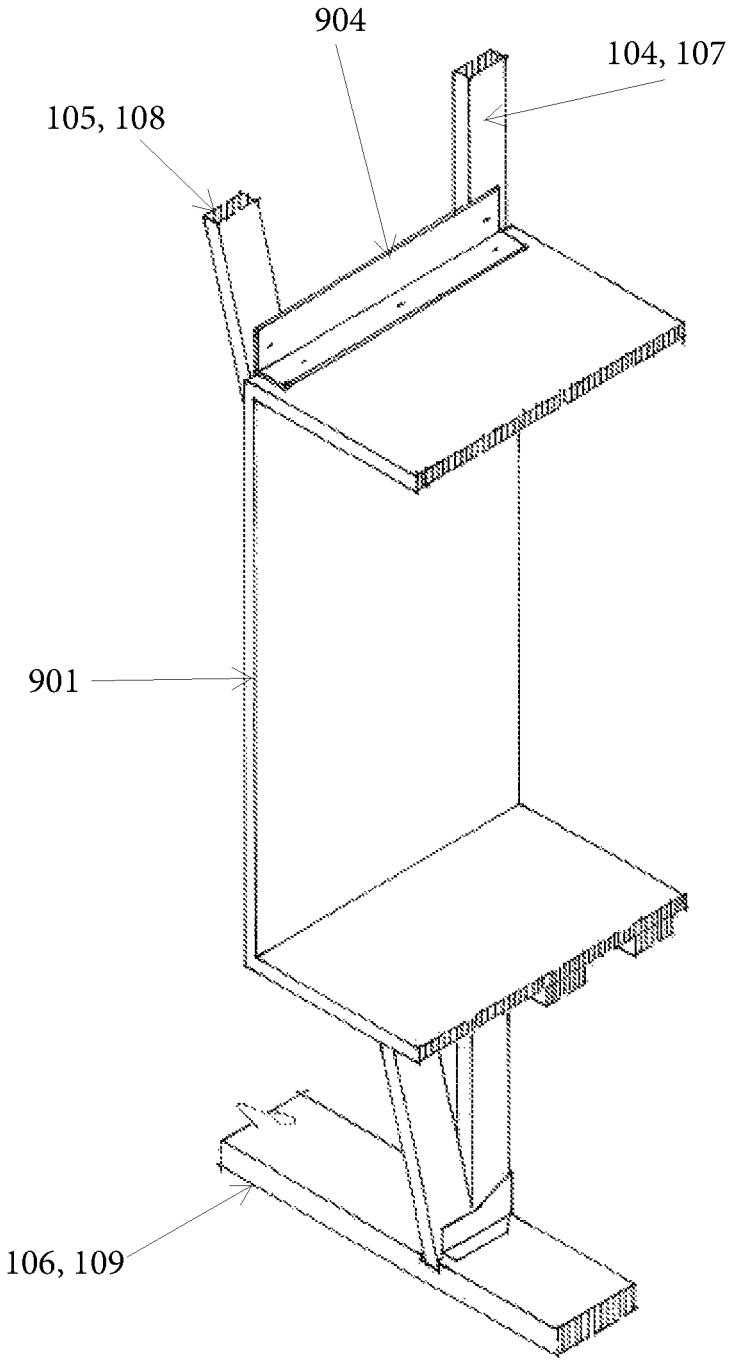
FIG. 14 illustrates a perspective view of a connector piece, according to embodiments of the present disclosure.

Some embodiments, as illustrated in FIG. 14, include a box-shaped connector piece 901. In some embodiments, the box-shaped connector piece 901 is attached to the inner chord 104, 107, and the outer chord 105, 108 using a plate 904. While half of the box-shaped connector piece 901 is shown in FIG. 14, the other half of the connector piece 904 may attach to an adjacent WRTBS 100 in substantially the same way. In some embodiments the box frame connector piece 901 can be used as a window frame or a door frame.

In some embodiments, the connector pieces 702, 901 and blocking elements 80, 90 are used to couple roof chords 112, 113, 114, 115, 116, 117 of adjacent WRTBS 100. Various embodiments may include any combination of the connector pieces 702, 901 and blocking elements 80, 90 described above.

What is claimed is:

1. A frame truss comprising:

a first wall truss comprising:

a first inner chord comprising:

a first end that is configured to couple with a first template plate, and a first length;

a first outer chord having a first end that is configured to couple with the first template plate, the first outer chord being non-parallel to the first inner chord, the first inner chord having a second end configured to couple with an upper truss, and the first outer chord having a second end configured to couple with the upper truss; and a second wall truss comprising:

a second inner chord comprising:

a first end that is configured to couple with a second template plate, and a second length, wherein the first length of the first inner chord is different from the second length of the second inner chord;

a second outer chord having a first end configured to couple with the second template plate, the second outer chord being non-parallel to the second inner chord; the second inner chord having a second end configured to couple with the upper truss, and the second outer chord having a second end configured to couple with the upper truss;

wherein the first inner chord is substantially parallel to the second inner chord.

2. The frame truss of claim 1, wherein:

the upper truss comprises a first upper chord and a second upper chord, wherein the first upper chord is configured to couple to the first wall truss, and the second upper chord is configured to couple to the second wall truss.

3. The frame truss of claim 1, wherein:

the upper truss comprises a first upper chord and a second upper chord;

the first upper chord has a first end configured to couple with the first wall truss and a second end configured to couple with the second upper chord; and the second upper chord has a first end configured to couple with the second wall truss and a second end configured to couple with the first upper chord.

4. The frame truss of claim 1, further comprising:

a hinge coupling the second end of the second inner chord with the upper truss.

5. The frame truss of claim 1, further comprising a connector-piece with a first end configured to couple with the first outer chord and a second end configured to couple with the first inner chord.

6. The frame truss of claim 1, wherein:

the first template plate has a first groove that couples with the first end of the first outer chord and the first end of the inner chord; and the second template plate has a second groove that couple with the first end of the second outer chord and the first end of the second inner chord.

7. The frame truss of claim 1, wherein:

the upper truss comprises:

a lower chord with a first end and a second end, and a lower-most chord with a first end, wherein the first end of the lower-most roof chord is coupled to the lower roof chord between the first end and the second end of the lower roof chord.

8. A frame truss comprising:

a roof element comprising:

a lower roof chord with a first end and a second end, a first upper roof chord, a second upper roof chord, and a lower-most roof chord with a first end, wherein the first end of the lower-most roof chord is coupled to the lower roof chord between the first end and the second end of the lower roof chord;

a first template plate, a first wall comprising:

a first inner chord having a first end coupled to the first template plate and a second end coupled to the lower roof chord, a first outer chord having a third end coupled to the first template plate and a fourth end coupled to the first upper roof chord, a first distance between the first end of the first inner chord and the third end of the first outer chord being less than a second distance between the second end of the first inner chord and the fourth end of the first outer chord; and a second wall comprising:

a second template plate;

a second inner chord having a fifth end coupled to the second template plate and a sixth end coupled to the second upper roof chord, wherein the first inner chord is substantially parallel to the second inner chord; and a second outer chord having a seventh end coupled to the second template plate and an eighth end coupled to the-second upper roof chord, and a third distance between the fifth end of the second inner chord and the seventh end of the second outer chord being less than a fourth distance between the sixth end of the second inner chord and the eighth end of the second outer chord.

9. The frame truss of claim 8, wherein:

the first upper roof chord is configured to couple with the second and fourth ends and the second upper roof chord is configured to couple with the sixth and eighth ends.

10. The frame truss of claim 8, further comprising:

a hinge coupling the fifth end and the roof element.

11. The frame truss of claim 8, further comprising:

a connector piece coupled to the first outer chord and the first inner chord.

12. The frame truss of claim 8, wherein:

the first template plate has a groove configured to couple the first end to the third end.

13. The frame truss of claim 8, wherein the second distance is greater than the fourth distance.

14. The frame truss of claim 8 wherein the first inner chord has a first length and the second inner chord has a second length, wherein the first length is different from the second length.

15. A building structure system comprising:

a first frame truss and a second frame truss, wherein the first frame truss and the second frame truss each comprise:

a roof element comprising:

a first chord having a first length and a second chord having a second length, wherein the first chord is coupled to the second cord and the first length is different from the second length;

a first wall comprising a first inner chord and a first outer chord, the first inner chord being non-parallel to the first outer chord, a second wall comprising a second inner chord and a second outer chord, the second inner chord being non-parallel to the second outer chord, wherein the first inner chord is substantially parallel to the second inner chord, the first inner chord has a first length and the second inner chord has a second length, wherein the first length and second length are different, and the first outer chord and the first inner chord having a first angle, and the second outer chord and the first inner chord having a second angle, wherein the first and second angles are different.

16. The building structure system of claim 15, further comprising:

a perpendicular blocking element coupling the first frame truss to the second frame truss, the perpendicular blocking element comprising:

a first notch configured to engage with the first inner chord of the first frame truss to create a friction fitting between the perpendicular blocking element and the first inner chord of the first frame truss, and a second notch configured to engage with the first inner chord of the second frame truss to create a friction fitting between perpendicular blocking element and the first inner chord of the second frame truss.

17. The building structure system of claim 16, wherein the perpendicular blocking element is composed of a composite material.

18. The building structure system of claim 15 further comprising:

a diagonal blocking element coupling the first frame truss to the second frame truss, the diagonal blocking element comprising:

a first notch configured to engage with the first inner chord of the first frame truss to create a friction fitting between the diagonal blocking element and the first inner chord of the first frame truss, and a second notch configured to engage with the first outer chord of the second frame truss to create a friction fitting between diagonal blocking element and the first outer chord of the second frame truss.

19. The building structure system of claim 18, wherein the diagonal blocking element is composed of a composite material.

* * * * *